US007546067B2

(12) United States Patent
Park

(10) Patent No.: US 7,546,067 B2
(45) Date of Patent: Jun. 9, 2009

(54) TWO-COMPONENT DELIVERY SYSTEM TO TRANSFER A MIXTURE OF A FIRST AND A SECOND MATERIAL

(75) Inventor: Jong-hyun Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 385 days.

(21) Appl. No.: 11/396,483

(22) Filed: Apr. 4, 2006

(65) Prior Publication Data

US 2006/0222410 A1 Oct. 5, 2006

(30) Foreign Application Priority Data

Apr. 4, 2005 (KR) ..... 10-2005-0027942

(51) Int. Cl.
*G03G 15/08* (2006.01)

(52) U.S. Cl. ..... 399/254; 399/256; 399/259

(58) Field of Classification Search ..... 399/254, 399/256, 259
See application file for complete search history.

(56) References Cited

U.S. PATENT DOCUMENTS 6,377,767 B1 4/2002 Fukushima et al.
6,456,809 B1 * 9/2002 Sekiguchi ..... 399/254

FOREIGN PATENT DOCUMENTS

| | | |
|---|---|---|
| JP | 63-125963 | 5/1988 |
| JP | 02-042467 | 2/1990 |
| JP | 07-253711 | 10/1995 |
| JP | 2001-209240 | 8/2001 |
| JP | 2003-107859 | 4/2003 |
| KR | 2001-60335 | 7/2001 |

OTHER PUBLICATIONS

Notice of Official Action issued May 22, 2006 by the Korean Intellectual Property Office re: Korean Application No. 2005-27942 (3 pp).

* cited by examiner

*Primary Examiner*—David M Gray
*Assistant Examiner*—Ryan D Walsh
(74) *Attorney, Agent, or Firm*—Stein McEwen, LLP

(57) ABSTRACT

A two-component developing unit having an OPC, a toner supply part supplying toner, and a carrier circulating part including a carrier and circulating the carrier to mix the toner with the carrier and deliver the toner onto the OPC, includes a housing with a hollow body connecting the toner supply part and the carrier circulating part, a rotating shaft inside the housing extending from the toner supply part to the carrier circulating part; a right delivering wing discontinuously formed on the rotating shaft with gaps and which delivers the toner and the carrier from the toner supply part to the carrier circulating part; and a reverse delivering wing in the gaps of the right delivering wing which delivers the toner and the carrier in a reverse direction of the right delivering wing.

9 Claims, 8 Drawing Sheets

TWO-COMPONENT DELIVERY SYSTEM TO TRANSFER A MIXTURE OF A FIRST AND A SECOND MATERIAL

CROSS-REFERENCE TO RELATED APPLICATION

This application claims the benefit of Korean Patent Application No. 2005-27942, filed on Apr. 4, 2005 in the Korean Intellectual Property Office, the disclosure of which is incorporated herein by reference.

BACKGROUND OF THE INVENTION

1. Field of the Invention

Aspects of the present invention relate to a two-component developing unit, and more particularly, to a two-component developing unit improving a delivery screw used in returning a toner.

2. Description of the Related Art

Conventionally, an image forming device includes a feeder, a developing unit, a fixing unit, and a discharge unit. The feeder supplies a printing paper into the image forming unit. The developing unit selectively coats a developer on the printing paper and forms a predetermined image. The fixing unit fixes the coated developer on the printing paper. The discharge unit receives the printing paper fixed with the developer from the fixing unit and discharges the received paper outside of the device.

The developing unit comprises an opto photo-organic conductor (OPC), a developing roller, and transferring roller. A latent image is formed on the OPC, which is exposed to a predetermined light. The developing roller supplies the developer to the latent image and develops the image. The transferring roller transfers a developed image formed on the OPC to the printing paper.

The developing unit can be of two types. One type is a one component developing unit, which uses only the toner. Another type is a two-component developing unit, which uses the toner and a carrier. The two-component developing unit has been widely used because this type can develop at high speed as compared with the one component developing unit. Further, the two component developing unit has good reproducibility in gradation.

The conventional two-component developing unit includes a carrier circulating part, which mixes the toner with the carrier and circulates the carrier to deliver to the developing roller. Where the toner is supplied to a circulating pathway in which the carrier circulates, the developing roller may receive the toner which is not sufficiently mixed or charged. Therefore, a toner supply part, which supplies the toner, is mounted outside the carrier circulating pathway so that the toner is sufficiently charged in the delivering process.

In order to allow the toner to be mixed and delivered with the carrier in where deliverability of the toner has otherwise decreased when the toner supply part supplies the toner to outside the carrier circulating pathway, a two-way delivery needs to deliver the toner to inside the carrier circulating part. That is, the carrier is delivered to near the toner supply part, at the same time, the toner and the carrier are delivered to near the carrier circulating part.

FIGS. 1 and 2 are schematic views illustrating a conventional two-component developing unit. As shown therein, the two-component developing unit 1 comprises an OPC 10, a developing roller 20, a carrier circulating part 30, a toner carrying part 40 and a toner supply part 50. The OPC 10 forms a latent image. The developing roller 20 is made of a magnetic material and receives the toner from the carrier circulating part 30. The developing roller 20 supplies the received toner to the latent image formed on the OPC 10, which then develops the image. The carrier circulating part 30 includes the carrier. The carrier circulating part 30 mixes the carrier with the toner, and circulates the carrier to deliver the toner to the developing roller 20 to form the pathway A-B-C-D-A. The toner supply part 50 is spaced from the carrier circulating part 30 and supplies the toner from outside of the carrier circulating pathway A-B-C-D-A.

The carrier circulating part 30 comprises a first delivering screw 32, a second delivering screw 34, a first sidewall 36 and a second sidewall 38. The toner and the carrier are mixed and delivered by the first delivering screw 32 in an "A" direction, and are redirected in the "B" direction at the first sidewall 36. The second delivering screw 34 delivers the mixed toner and carrier in the "C" direction. In this process, the carrier is carried to the developing roller 20 by a magnetic force generated by the magnetic material of the developing roller 20. At the same time, the toner attached to the carrier is supplied to the developing roller 20. The toner and the carrier, which are delivered by the second delivering screw 34, are redirected and moved in the "D" direction by the second sidewall 38 and are delivered to the first delivering screw 32.

The first delivering screw 32 close to the toner supply part 50 is formed to tilt downwardly in a predetermined angle d. A side of the first delivering screw 32 forms an upper stream, and a side of the second sidewall 38 and the toner carrying part 40 extended from the second sidewall 38 form a lower stream.

The toner carrying part 40 is disposed between the toner supply part 50 and the carrier circulating part 30. The toner carrying part 40 comprises a housing 41, a rotating shaft 42, and a longitudinal wing 43. The toner carrying part 40 is disposed at a lower side of a vertical direction of the carrier circulating part 30 so that the carrier flows from the carrier circulating part 30 to the toner carrying part 40 by its own weight. The rotating shaft 42 extends to the first delivering screw 32. The rotating shaft 42 near the toner supply part 50 is also formed to tilt downwardly in the predetermined angle d to correspond with a slope of the first delivering screw 32. The right delivering wing 44 is formed in a part of the rotating shaft 42 in an axial direction of the rotating shaft 42, and delivers the toner supplied from the toner supply part 50 and the carrier received from the carrier circulating part 30 to near the carrier circulating part 30 ("a" direction).

The longitudinal wing 43 is extended in a radial direction along the axial direction of the rotating shaft 42, and mixes the toner and the carrier. The longitudinal wing 43 decreases a delivering speed in the right direction ("a" direction) according to the right delivering wing 44 and ensures sufficient time for mixing the toner and the carrier. Further, the longitudinal wing 43 does not prevent the carrier from flowing into the toner carrying part 40 in a "b" direction along the slope.

The carrier flows into the toner carrying part 40 in the "b" direction by descending according its own weight along the slope of the carrier circulating part 30 and the toner carrying part 40. The right delivering wing 44 and the longitudinal wing 43 mix the carrier and the toner, and simultaneously deliver the mixed carrier and toner to the carrier circulating part 30 in the "a" direction. Accordingly, the conventional two-component developing unit 1 moves the carrier from the carrier circulating part 30 into the toner carrying part 40, at the same time, the two-component developing unit 1 mixes the toner, which is inputted newly, and the carrier, and then again supplies mixed toner and carrier to the carrier circulating part 30. Such a two-component developing unit 1 is disclosed in Japanese Patent First Publication No. 1995-253711.

However, the conventional two-component developing unit 1 uses a slope in order to move the carrier in the b direction. As such, the carrier circulating part 30 and the toner carrying part 40 are only able to deliver the carrier of the carrier circulating part 30 to the toner carrying part 40 to be mixed with additional toner using gravity. Therefore, where the two-component developing unit 1 does not maintain the predetermined angle d (such as when the developing unit 1 is placed on a sloping surface effectively reducing the predetermined angle d), the carrier can not flow back into the toner carrying part 40 in direction b. As such, the toner also can not be delivered to the carrier circulating part 30.

Further, the two-component developing unit 1 is a passive delivery system. Thus, the two-component developing unit 1 uses the carrier's own weight to deliver the carrier. Therefore, the two-component developing unit 1 is sensitive a variation of rpm (revolution per minute) of the first delivering screw 32 and the second delivering screw 34 and a variation of fluidity of the toner and the carrier. Since the fluidity of the toner and the carrier changes according to a particle diameter of the carrier and toner, the density (toner volume/carrier volume), a deterioration variation, a temperature, humidity, and a used frequency, the two-component developing unit 1 is not easy to ensure stably the toner delivery in view of its sensitivity to changes in foregoing various conditions.

Further, the longitudinal wing 43 of the two-component developing unit 1 mixes the toner and the carrier, but a delivering force, which can deliver the toner and the carrier in the "a" direction, is weak. Thus, the toner may be accumulated in the toner carrying part 40 and the toner may be delayed in being delivered to the carrier circulating part 30.

SUMMARY OF THE INVENTION

Accordingly, it is an aspect of the present invention to provide to a two-component developing unit capable of providing two-way delivery stably independent of a slope variation of the unit, a rpm variation of a delivering screw of the unit, and/or fluidity variation of a toner and a carrier being delivered by the unit.

According to an aspect of the present invention, a two-component developing unit having an opto photo-organic conductor (OPC); a toner supply part supplying a toner, a carrier circulating part including a carrier and circulating the carrier to mix the toner with the carrier and deliver the toner onto the OPC; a housing having a hollow body connecting the toner supply part and the carrier circulating part respectively; a rotating shaft disposed inside of the housing extending from the toner supply part to the carrier circulating part; a right delivering wing discontinuously formed on the rotating shaft to deliver the toner and the carrier from the toner supply part to the carrier circulating part; and a reverse delivering wing provided on the rotating shaft between adjacent elements of the right delivering wing to deliver the toner and the carrier in a reverse direction of the right delivering wing.

According to an aspect of the present invention, the two-component developing unit further comprises a first discontinuous end part of the right delivering wing to face the toner supply part and a fourth discontinuous end part of the reverse delivering wing to face the carrier circulating part, wherein the first discontinuous end part of the right delivering wing is successively connected with the fourth discontinuous end part of the reverse delivering wing.

According to an aspect of the present invention, the two-component developing unit further comprises a second discontinuous end part of the right delivering wing to face the carrier circulating part and a third discontinuous end part of the reverse delivering wing to face the toner supply part, wherein the second discontinuous end part of the right delivering wing is not successively connected with the third discontinuous end part of the reverse delivering wing.

According to an aspect of the present invention, the two-component developing unit further comprises a unit delivering wing including the right delivering wing and the reverse delivering wing, wherein the unit delivering wing is periodically formed along the rotating shaft.

According to an aspect of the present invention, the unit delivering wing is formed with a period n/m(n<m) of a period of the right delivering wing, and a pitch of the reverse delivering wing is equal to or larger than a multiple of a pitch of the right delivering wing and n/m−n.

According to an aspect of the present invention, the unit delivering wing is formed with the period that is ⅔ of the period right delivering wing.

According to an aspect of the present invention, the carrier circulating part comprises a delivering screw to mix the toner and the carrier and deliver the toner to the OPC, and the rotating shaft is extended to the delivering screw.

BRIEF DESCRIPTION OF THE DRAWINGS

The above and/or other aspects and advantages of the present invention will become apparent and more readily appreciated from the following description of the embodiments, taken in conjunction with the accompany drawings of which.

DETAILED DESCRIPTION OF THE EMBODIMENTS

Figure 1:
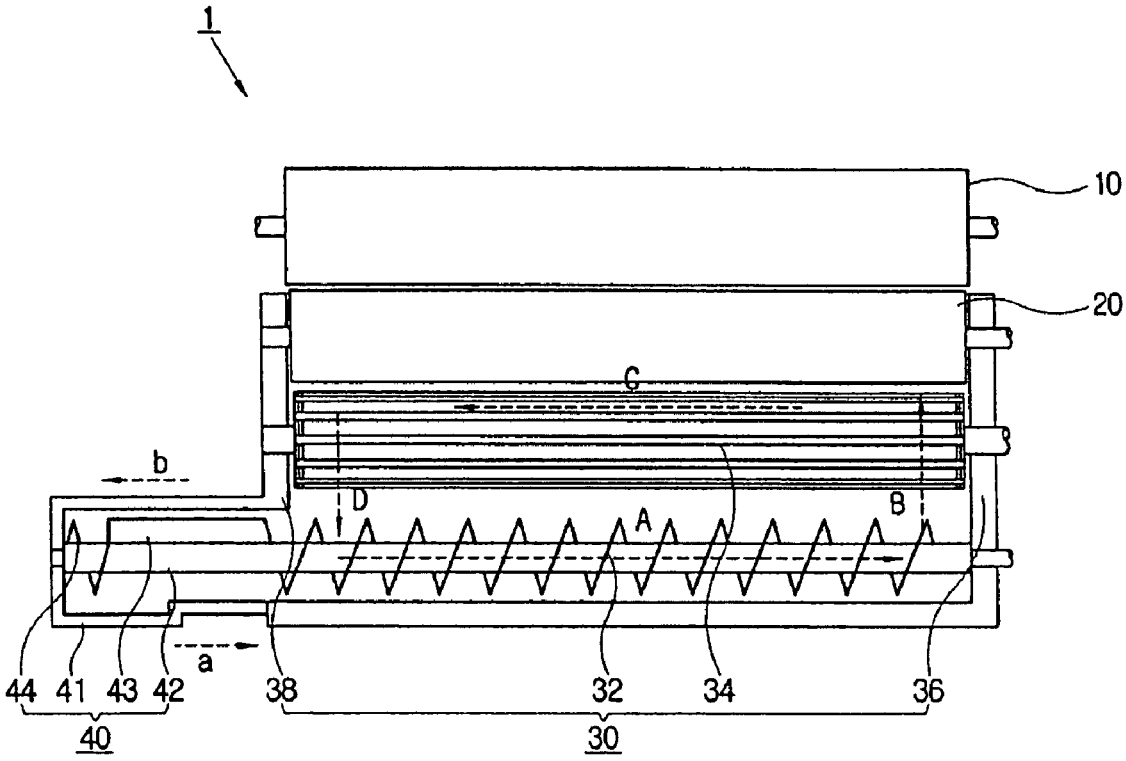
FIG. 1 (PRIOR ART)
FIG. 1 is a plane view illustrating a conventional two-component developing unit.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 3:
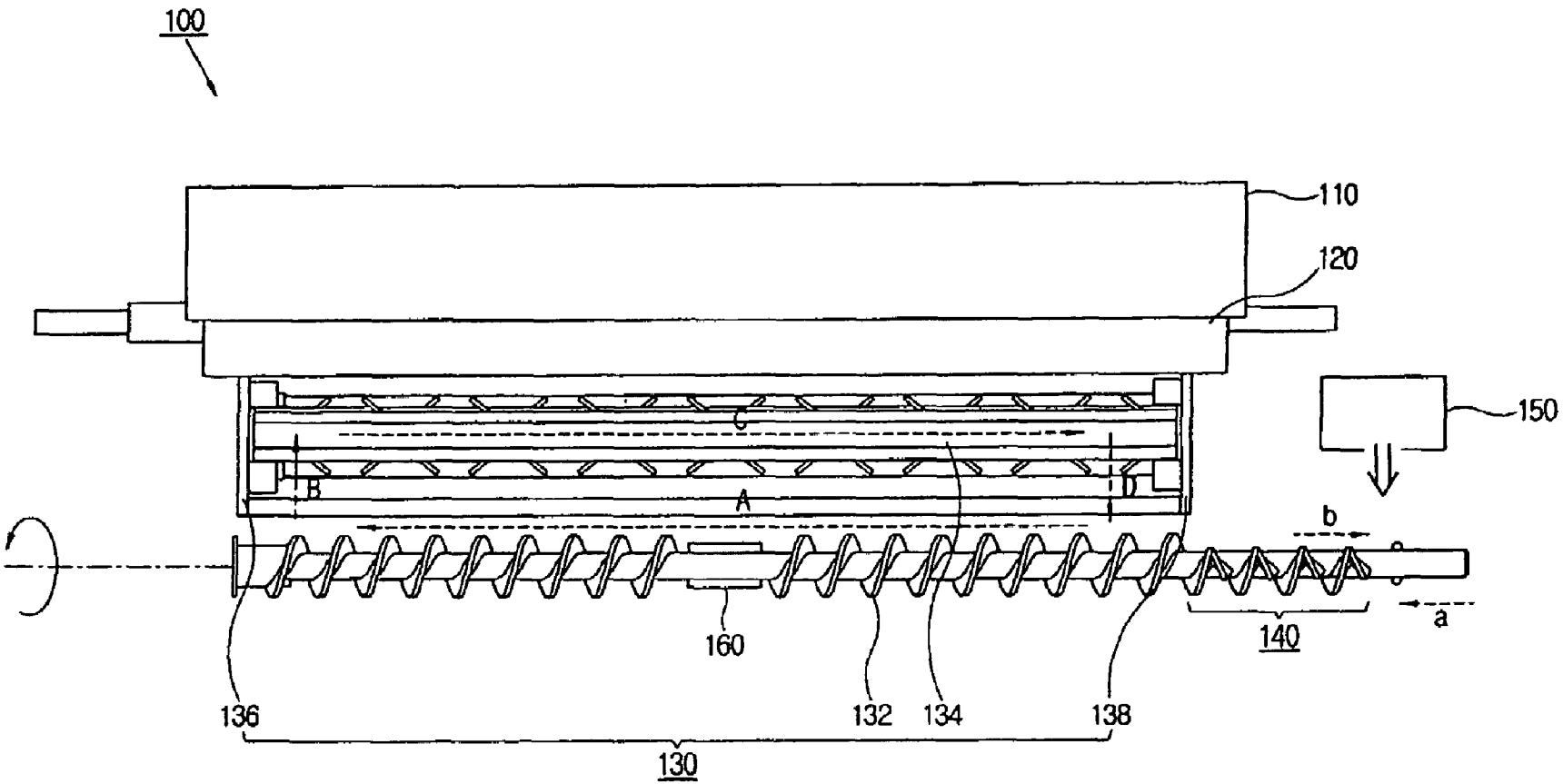
FIG. 3 is a plane view of a two-component developing unit according to an embodiment of the present invention.

FIG. 3 is a schematic view illustrating a two-component developing unit 100 according to an embodiment of the present invention. As shown therein, the two-component developing unit 100 comprises an OPC 110, a developing roller 120, a carrier circulating part 130, a toner carrying part 140 and a toner supply part 150. The OPC 110 is exposed to light that is scanned from a light emitting unit (not shown).

Figure 4:
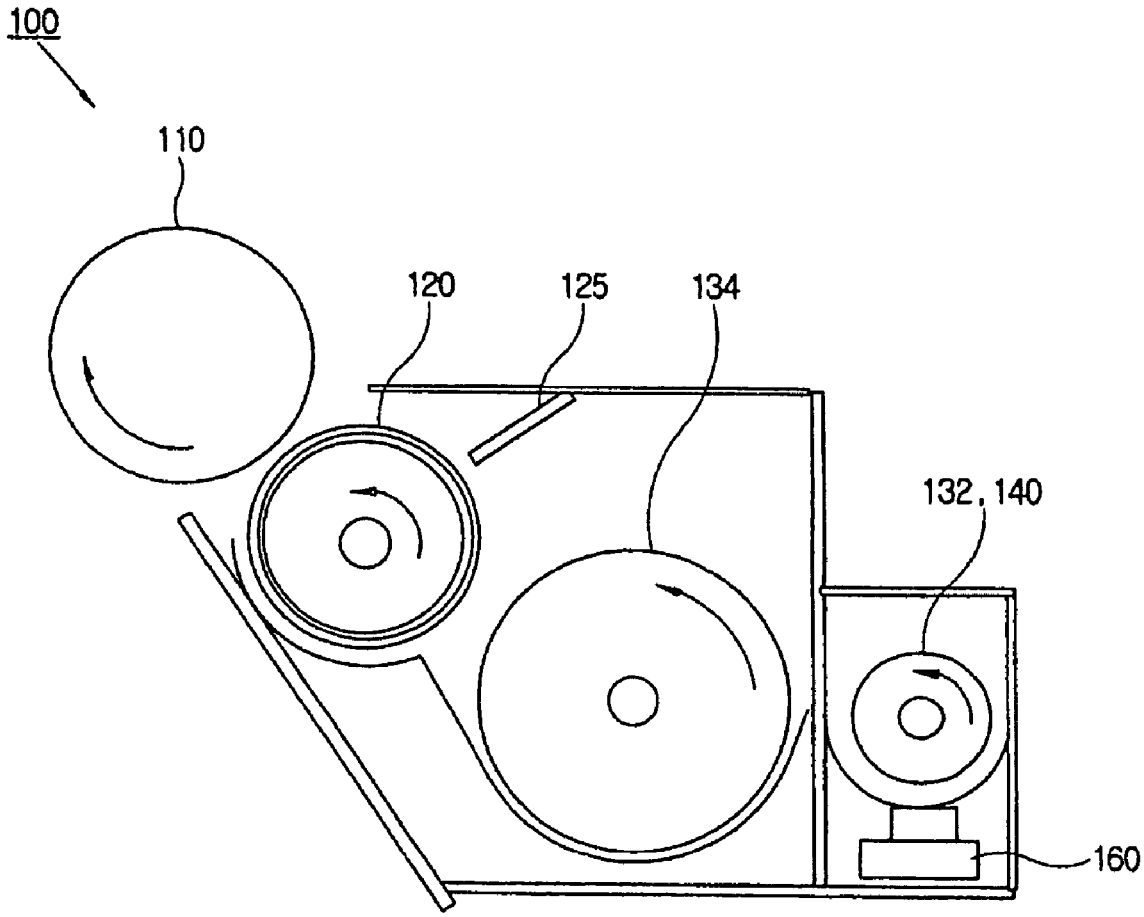
FIG. 4 is a side view illustrating the two-component developing unit of FIG. 3.

The OPC 110 forms an electrostatic latent image using the exposed light. The developing roller 120 supplies the toner to the OPC 110, and then develops the latent image. A doctor blade 125 (refer to FIG. 4) controls amounts of the toner which are supplied from the developing roller 210 onto the OPC 110.

The carrier circulating part 130 includes the carrier which is made of iron and ferrite and the like and has reasonable deliverability. The carrier circulating part 130 mixes the carrier with the toner and delivers the carrier together with the toner attached to the carrier. The carrier circulating part 130 comprises a first delivering screw 132, a second delivering screw 134, a first sidewall 136 and a second sidewall 138. The first delivering screw 132 and the second delivering screw 134 are provided in parallel with the developing roller 120 respectively. The second delivering screw 134 is adjacent to the developing roller 120 along an axial direction of the screw 134 such that the screw 134 is between the screw 132 and roller 120. The first sidewall 136 and the second sidewall 138 are provided in both end parts of the first delivering screw 132 and the second delivering screw 134 respectively in a radial direction of the screws 132, 134. However, it is understood that the carrier circulating part 130 can be otherwise constructed, such as where the screws 132 and 134 are not substantially parallel with each other.

The carrier included in the carrier circulating part 130 and the toner supplied from the toner carrying part 140 are mixed by the first delivering screw 132 and the second delivering screw 134. Then, the carrier and the toner circulate along a carrier circulating pathway (A-B-C-D-A). The carrier and the toner are mixed and delivered along the axis direction ("A" direction) of the first delivering screw 132 by the first delivering screw 132. The carrier and the toner are redirected by the first sidewall 136 and are moved in a "B" direction. When the toner and the carrier are supplied to the second delivering screw 134, the second delivering screw 134 mixes and delivers the toner and the carrier in the axis direction ("C" direction). In this process, the carrier is carried to the developing roller 120 by the magnetic force of the developing roller 120 (which is made of a magnetic material). The toner attached to the carrier is also carried to the developing roller 120. The toner and the carrier, which reach to the second sidewall 138, are redirected and moved in the "D" direction and thus are supplied to the first delivering screw 132 and again delivered in the "A" direction.

The toner supply part 150 supplies the toner to the toner carrying part 140, which is spaced from the carrier circulating part 130. Therefore, the toner is supplied outside the carrier circulating pathway (A-B-C-D-A). Also, the toner is sufficiently mixed with the carrier and charged while being delivered to the OPC 110.

A toner sensor 160 (refer to FIG. 4) senses a density of the toner within the mixture of toner and carrier (T/C: Toner volume/carrier volume) which circulates in the carrier circulating part 130. Where the toner sensor 160 senses that the density of the toner is lower than a predetermined density value, the toner supply part 150 supplies additional toner to the toner carrying part 140 to thus increase the density of the toner circulating in the carrier circulating part 130. Otherwise, no additional toner is supplied so as to maintain the density at substantially the predetermined amount.

The toner carrying part 140 is between the toner supply part 150 and the carrier circulating part 130. The toner carrying part 140 receives the new toner from the toner supply part 150, and delivers the carrier and the toner which circulate along the carrier circulating pathway (A-B-C-D-A) from the carrier circulating part 130, to near the toner supply part 150 ("b" direction). Further, The toner carrying part 140 mixes the new supplied toner and the delivered carrier and toner, and delivers mixed toner and carrier to the carrier circulating part 130 ("a" direction). As such, the toner carrying part 140 pushes the toner and/or carrier in two directions.

Figure 5:
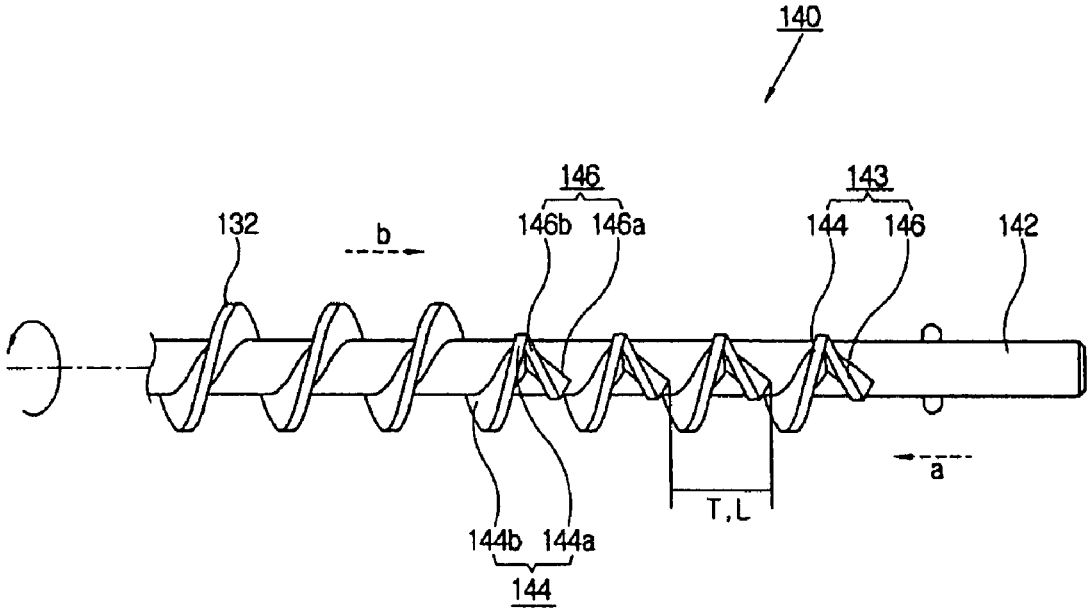
FIG. 5 is a schematic view illustrating main parts of the two-component developing unit of FIG. 3.

As shown in FIG. 5, the toner carrying part 140 comprises a housing (not shown), a rotating shaft 142, right delivering wings 144 and reverse delivering wings 146. The housing (not shown) is interposed between the toner supply part 150 and the carrier circulating part 130 and includes a hollow body connecting the toner supply part 150 and the carrier circulating part 130. The toner carrying part 140 has no need to be disposed at a lower side of a vertical direction of the carrier circulating part 130 along a slope. However, it is understood that such an arrangement is possible according to an aspect of the invention.

The rotating shaft 142 is rotatably supported inside the housing (not shown) of the hollow body, and extends from the toner supply part 150 to the carrier circulating part 130. The rotating shaft 142 is provided in a discontinuous end side of the first delivering screw 132 adjacent to the toner supply part 150, and extends in the axial direction of the first delivering screw 132. The rotating shaft 142 may be formed with the first delivering screw 132 integrally as shown. Alternatively, the rotating shaft 142 may extend in a different direction than the shaft direction of the first delivering screw 132 according to an aspect of the invention. According to other aspects, the rotating shaft 142 may not extend to the first delivering screw 132, and/or may receive the toner and carrier directly from the carrier circulating part 130 or deliver the toner and carrier directly to the carrier circulating part 130.

The right delivering wings 144 are formed at the rotating shaft 142 to actively deliver (i.e., push) the toner and the carrier from the toner supply part 150 to the carrier circulating part 130 in the axial direction of the rotating shaft 142 ("a" direction). The right delivering wings 144 is discontinuously formed along the axial direction of the rotating shaft 142 such that gaps exist between adjacent right delivering wings 144. Each shown right delivering wing 144 comprises a first discontinuous end part 144*a* facing the toner supply part 150 in direction b and a second discontinuous end part 144*b* facing the carrier circulating part 130 in direction a. The right delivering wings 144 are formed discontinuously such that gaps exist between opposing the discontinuous end parts 144*a* and 144*b* of adjacent pairs of the right delivering wings 144. The right delivering wing 144 mixes the new toner supplied from the toner supply part 150 and the toner and the carrier which flow from the carrier circulating part 130, and then delivers the new toner and the existing toner and carrier by pushing the mixture in the "a" direction.

The reverse delivering wings 146 are formed at the rotating shaft 142 in a reverse direction of the right delivering wings 144 to deliver (i.e., push) the toner and the carrier from the carrier circulating part 130 to the toner supply part 150 in the direction b. Each reverse delivering wing 146 is formed between adjacent pairs of the right delivering wings 144 such that the reverse delivering wings 146 are also discontinuously formed along the rotating shaft 142. Each reverse delivering wing 146 comprises a third discontinuous end part 146*a* facing the toner supply part 150 in direction b and a fourth discontinuous end part 146*b* facing the carrier circulating part 130 in direction a. If some of the toner and the carrier, which are delivering in the "D" direction along the second sidewall 138 in the carrier circulating part 130, flows into the toner carrying part 140, the reverse delivering wing 146 delivers the toner and the carrier to the toner supply part 150 ("b" direction).

Each reverse delivering wing 146 is formed connected with a corresponding right delivering wing 144 to form a delivering wing unit 143. Specifically, the first discontinuous end part 144*a* of the right delivering wing 144 is connected with the fourth discontinuous end part 146*b* of the reverse delivering wing 146 for that unit 143. However, the second discontinuous end part 144*b* of the right delivering wing 144 is not connected with the third discontinuous end part 146*a* of the reverse delivering wing 146. It is understood that, in each unit 143, the first discontinuous end part 144*a* of the right delivering wing 144 does not need to be connected with the fourth discontinuous end part 146*b* of the reverse delivering wing 146 in all aspects of the invention.

For adjacent units 143, the second discontinuous end part 144*b* and the third discontinuous end part 146*a* are cut off due to a difference in angular position, but are located at the same circumference of the rotating shaft 142. Alternatively, the second discontinuous end part 144*b* and the third discontinuous end part 146*a* may be cut off due to being located at a different circumference of the rotating shaft 142. Where both second and third discontinuous end parts 144*b* and 146*a* are cut off due to being located on the different circumference of the rotating shaft 142, neither of the wings 144, 146 has an element between the both discontinuous end parts 144*b* and 146*a* according to an aspect of the invention.

However, it is understood that the second discontinuous end part 144*b* and the third discontinuous end part 146*a* can instead be connected with each other, and the first discontinuous end part 144*a* and the forth discontinuous end part 146*b* may be discontinuously cut off. Alternatively, each discontinuous end part of both delivering wings 144 and 146 may be connected each other or may be discontinuously cut off.

The unit delivering wing 143 includes adjacent pairs of the right delivering wing 144 and the reverse delivering wing 146. Adjacent pairs of unit wings 143 are located at a predetermined period T) along the rotating shaft 142. The unit delivering wings 143 may be formed to have a uniform period at rotating shaft 142 entirely, or to have portions with differing periods as a function of distance along the shaft direction. Further, the right delivering wing 144 and the reverse delivering wing 146 may be formed along the shaft direction alternately without a regular period according to other aspects of the invention.

Figure 6A:
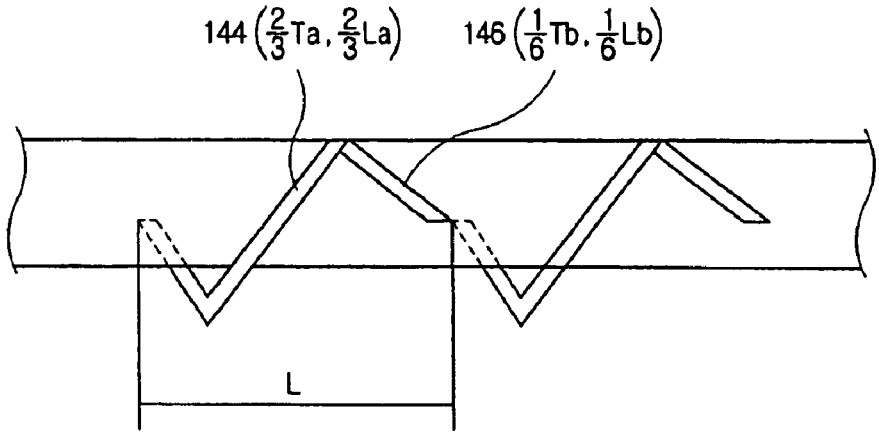
FIGS. 6A through 6C are schematic views illustrating pitches of a unit delivering wing, the right delivery wing, and the reverse delivery wing of FIG. 3.
Figure 6B:
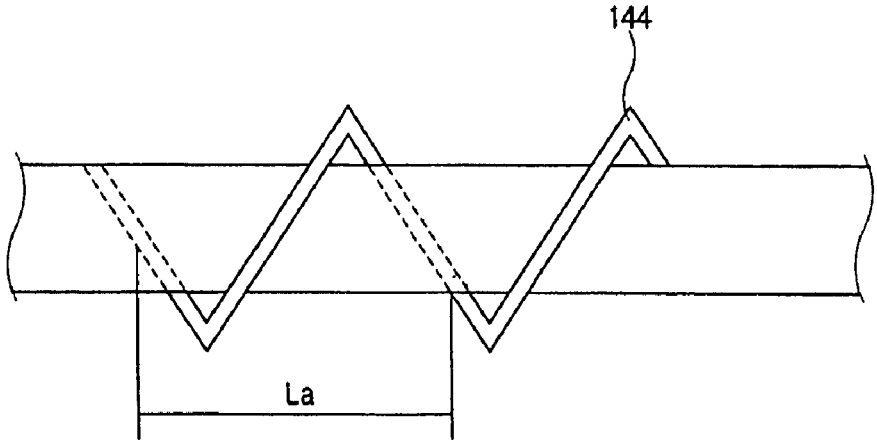
Figure 6C:
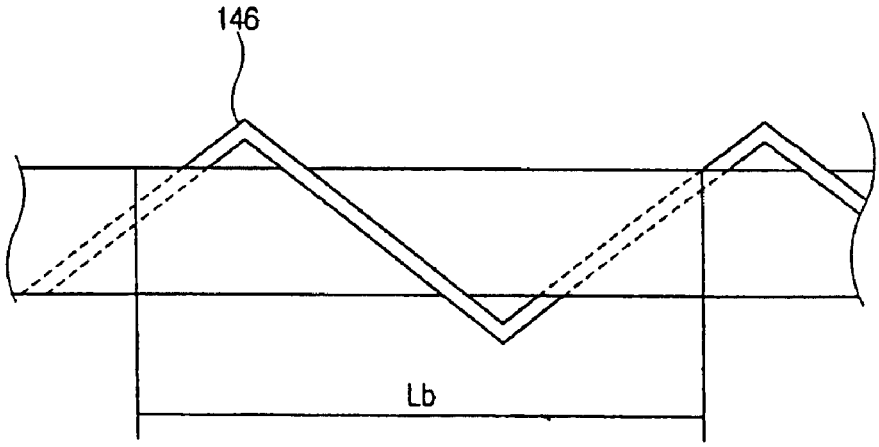

As shown in FIGS. 6A through 6C, the period of the unit delivering wing 143 is T. A period of the right delivering wing 144 is Ta. A period of the reverse delivering wing 146 is Tb. Additionally, the pitch of the unit wing 143 is L, the pitch of the wing 144 is La, and the pitch of the wing 146 is Lb. The unit delivering wing 143 is formed with a period T that is n/m (n<m) the period Ta of the right delivering wing 144. The pitch Lb of the reverse delivering wing 146 preferably is equal to or larger than a multiple of the pitch La and n/m-n. The pitch Lb of the reverse delivering wing 146 preferably is long in proportion to the pitch La of the right delivering wing 144 so that a lot of the pitch La of the right delivering wing 144 is formed in the unit delivering wing 143. As shown, the pitch La of the right delivering wing 144 is equal to or larger than the pitch L of the unit delivering wing 143.

The unit delivering wing 143 is formed with the right delivering wing 144 having the n/m (n<m) period Ta as below one period Tb of the right delivering wing 144, and may be formed with the reverse delivering wing 146 in a residual interval (L−La×n/m) with the exception of an interval (La×n/m), which is formed with the right delivering wing 144, in the pitch L of the unit delivering wing 143. The reverse delivering wing 146 is continuously formed at the first discontinuous end part 144*a* of the right delivering wing 144, and the reverse delivering wing 146 may be entirely or partially formed in the residual interval (L−La×n/m). Where the reverse delivering wing 146 is entirely formed in the residual interval (L−La×n/m), the pitch Lb of the reverse delivering wing 146 and the period Tb of the reverse delivering wing 146 formed within the unit delivering wing 143 may be adjusted so that the angular position of the third discontinuous end part 146*a* differs from that of the second discontinuous end part 144*b* so as to be discontinuous with each other.

While not required, it is preferred that the pitch L of the unit delivering wing 143 is equal to the pitch La of the right delivering wing 144, the pitch Lb of the reverse delivering wing 146 is twice as large as the pitch La of the right delivering wing 144. As such, the unit delivering wing 143 has a period T that is ⅔ of the period Ta of the right delivering wing 144 and ⅙ of the period Tb of the reverse delivering wing 146.

Hereinbelow, an embodiment according to the present invention and a comparative embodiment in experiments will be described in detail with reference to FIGS. 6A though the 8. While described for the purposes of understanding aspects of the present invention, the present invention is not limited to the examples set forth in the experiments.

EXPERIMENT 1

In Experiment 1, the carrier is silicon+acryl coated, ferrite carrier. The carrier has a particle density of 5.5 (g/cm$^3$). The toner is 8 μm polyester particles.

COMPARATIVE EMBODIMENT

Figure 2:
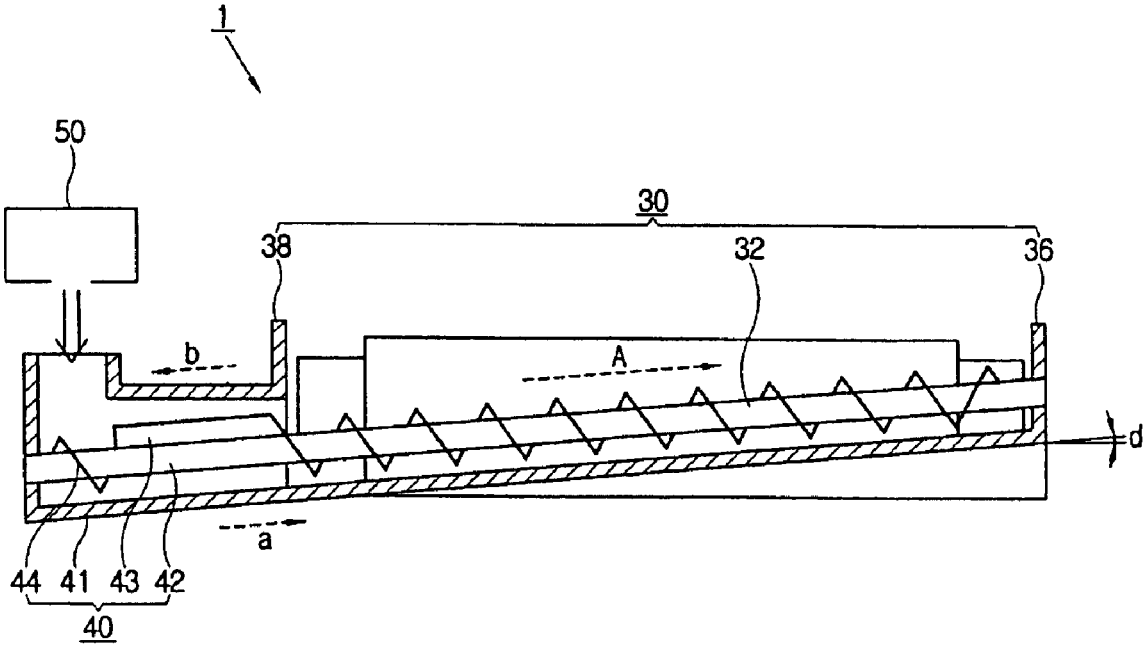
FIG. 2 (PRIOR ART)
FIG. 2 is a front view illustrating the conventional two-component developing unit of FIG. 1.
Figure 8:
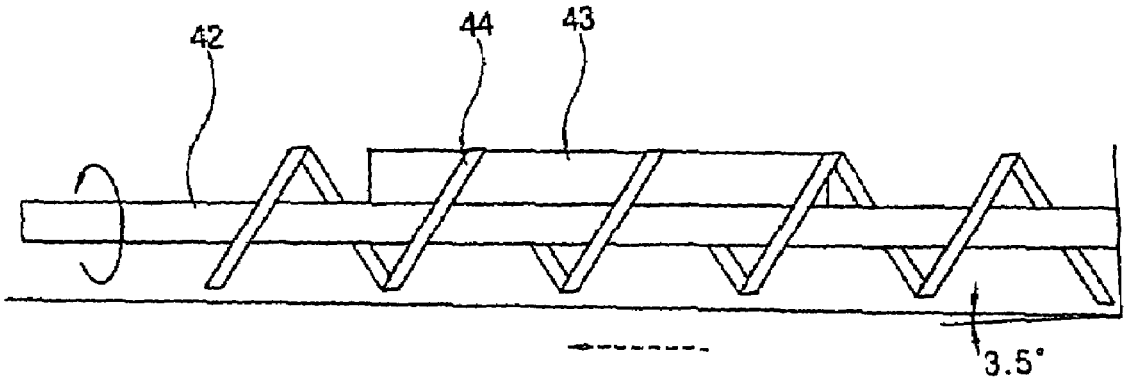
FIG. 8 is a schematic view illustrating a two-component developing unit according to a comparative embodiment of the present invention.

As shown in FIG. 8, the rotating shaft 42 has a slope angle of 3.5 degrees. The pitch La of the right delivering wing 44 is 10 mm. The outside diameter of the right delivering wing 44 is ϕ15 mm. The toner mix and delivery are accomplished by the right delivering wing 44 and the longitudinal wing 43 as described with reference to FIGS. 1 and 2.

EMBODIMENT

Figure 7:
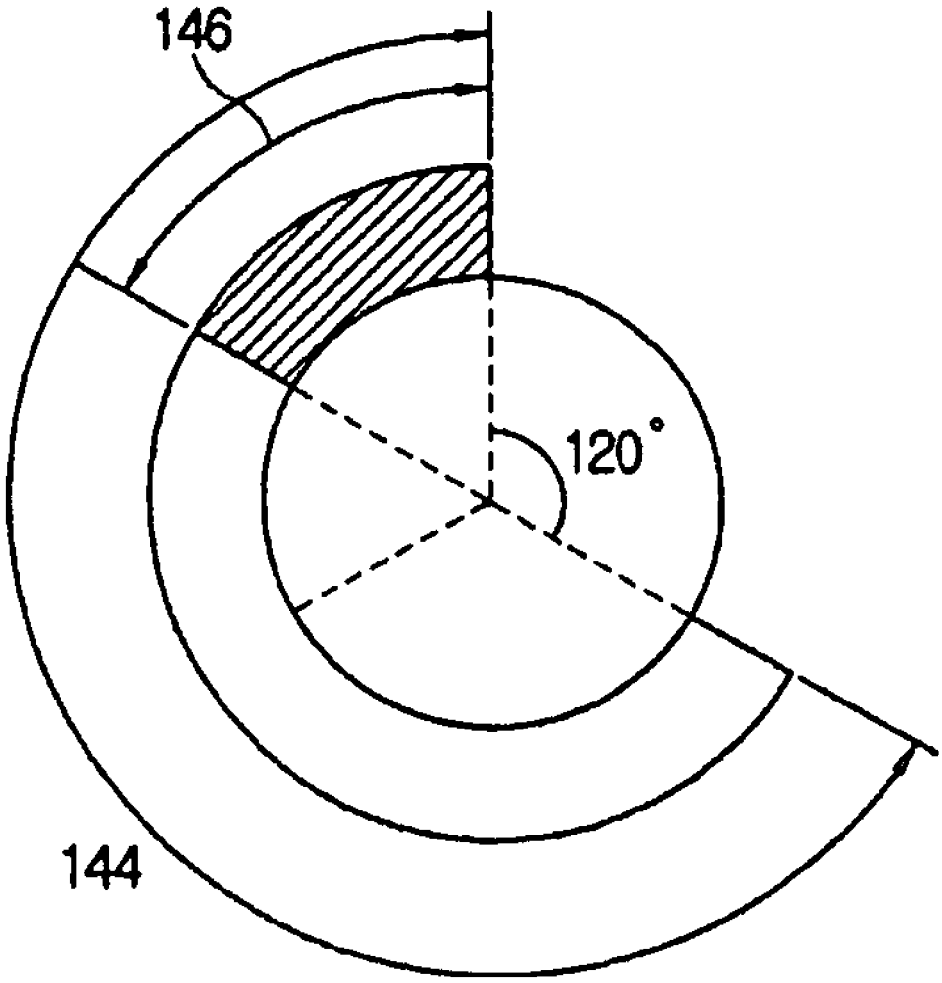
FIG. 7 is a schematic view illustrating each phase of the unit delivering wing of the FIG. 3.

As shown in FIGS. 5 through 7, the slope angle of the shaft 142 is 0 degrees. The right delivering wing 144 has a pitch La of 10 mm, an outside diameter of ϕ 15 mm, and has a period Ta such that the period T of the unit 143 is ⅔ Ta. The reverse delivering wing 146 has a pitch Lb of 20 mm, an outside diameter ϕ of 15 mm, and has a period Tb such that the period of the unit T is ⅙ Tb.

Various carrier particle diameters (PDs) and the toner densities were used in the devices with above conditions. The rotation frequency of the rotating shaft 142 and the rotation frequency of the second delivering screw 34, 134 are set up as 260 rpm and 120 rpm, respectively, and we made an experiment where the toner/carrier are delivered from the carrier circulating part 30, 130 to near the toner supply part 50, 150 of the toner carrying part 40, 140 as set forth with reference to FIGS. 3 and 4. The results of Experiment 1 are shown in Table 1.

TABLE 1

| Carrier PD (μm) | 20 | 30 | 40 | 50 | 60 | 70 | 80 |
|---|---|---|---|---|---|---|---|
| Toner density (%) | 15.4 | 9 | 6.3 | 4.8 | 3.8 | 3.2 | 2.7 |
| Comparative embodiment | x | x | x | Δ | Δ | Δ | Δ |
| Embodiment | ○ | ○ | ○ | ○ | ○ | ○ | ○ |

In Table 1, the toner density %=Toner volume/Carrier volume (%). 0 indicates that the toner/carrier mixture was delivered close to the toner supply part 150 of the toner carrying part 140 for both 120 rpm and 260 rpm. Δ indicates that the toner/carrier mixture was delivered close to the toner supply part 150 of the toner carrying part 140 for rotation speeds of only 120 rpm. x indicates that the toner/carrier mixture was not delivered close to the toner supply part 150 of the toner carrying part 140 for rotation speeds of 120 rpm and 260 rpm.

As shown in Table 1 for the comparative embodiment, if the rotating frequency of the delivery screw 34 becomes high, the toner/carrier mixture did not flow in the lower stream. The result also is the same as when the slope of the rotating shaft 42 is tilted from 50° to 10°.

In contrast, the embodiment shown in FIGS. 5 through 7, the toner/carrier is stably delivered to the toner supply part 150 without regard to a rotating frequency variation of the delivery screw 134 with respect to the various particle diameter of the carriers and the various toner density in state that the slope of the rotating shaft 132 is zero. Further, the toner/carrier mixture is delivered close to the toner supply part 150 of the toner carrying part 140 and is mixed with the new toner and smoothly delivered to the carrier circulating part 130.

EXPERIMENT 2

The unit delivering wing 143 T had the period ⅔ of the period Ta of the right delivering wing 144 and ⅙ of the period Tb of the reverse delivering wing 146. We made an experiment that the toner/carrier mixture is delivered from the carrier circulating part 130 to near the toner supply part 150 of the toner carrying part 140 while altering the pitch La of the right delivering wing 144 and the pitch Lb of the reverse delivering wing 146. The results of Experiment 2 are summarized in Table 2.

TABLE 2

| | | | |
|---|---|---|---|
| Pitch La of right delivering wing (mm) | 10 | 10 | 10 |
| Pitch Lb of reverse delivering wing (mm) | 7 | 10 | 20 |
| Delivering ability | x | Δ | ○ |

In Table 2, x indicates that the toner/carrier mixture was not delivered close to the toner supply part 150 of the toner carrying part 140. Δ indicates that a little bit of the toner/carrier mixture was delivered close to the toner supply part 150 of the toner carrying part 140. 0 indicates that the toner/carrier mixture was smoothly delivered close to the toner supply part 150 of the toner carrying part 140.

In the result of the Experiment 2 summarized in Table 2, the toner/carrier mixture was smoothly delivered close to the toner supply part 150 of the toner carrying part 140 when the pitch Lb of the reverse delivering wing 146 is larger than the pitch La of the right delivering wing 144.

While described in the context of image forming devices, it is understood that aspects of the invention can be used in other contexts where multidirectional transport and/or mixing are performed.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A two-component delivery system for use in delivering a mixture of a first and second material between a supply part, which supplies the first material at a mixing point, and a circulating part, which circulates the mixture to be transferred to another device, the system comprising:

a shaft which rotates; and a delivering wing unit on the shaft having a first surface and a second surface, where the first surface is shaped to push the first and/or second materials in a first direction from the mixing point to the circulating part, according to the rotation of the shaft, and the second surface is shaped to push the first and/or second materials in a second direction, from the circulating part to the mixing point, according to the rotation of the shaft, wherein the delivering wing unit is one of a plurality of delivering wing units on the shaft, and adjacent pairs of the delivering wing units are not connected, so as to form gaps therebetween.

2. The two-component delivery system of claim 1, wherein, each delivering wing unit includes a first wing including the first surface and a second wing including the second surface, and the first wing shares a common edge with the second wing.

3. A two-component delivery system for use in delivering a mixture of a first and second material between a supply part, which supplies the first material at a mixing point, and a circulating part, which circulates the mixture to be transferred to another device, the system comprising:

a shaft which rotates; and a delivering wing unit on the shaft having a first surface and a second surface, where the first surface is shaped to push the first and/or second materials in a first direction from the mixing point to the circulating part according to the rotation of the shaft and the second surface is shaped to push the first and/or second materials in a second direction from the circulating part to the mixing point according to the rotation of the shaft, wherein the first surface has a first screw shape twisted around the shaft at a first period and the second surface has a second screw shape twisted around the shaft at a second period different than the first period.

4. The two-component delivery system of claim 3, wherein the delivering wing unit is one of a plurality of delivering wing units on the shaft, and, for each adjacent pair of delivering wing units, a gap is formed between adjacent delivering wing units.

5. The two-component delivery system of claim 3, wherein a first pitch of the first screw shape is less than a second pitch of the second screw shape.

6. The two-component delivery system of claim 3, wherein:

the delivering wing unit is one of a plurality of delivering wing units on the shaft, and each of the delivering wing units are disposed at a unit period along the shaft that is n/m of the first period, in which n and m are positive integers and n<m.

7. The two-component delivery system of claim 6, wherein a second pitch of the second screw shape is equal to or larger than a multiplication result of a first pitch of the first screw shape and n/(m−n).

8. The two-component delivery system of claim 3, wherein:

the delivering wing unit is one of a plurality of delivering wing units disposed at a unit period along the shaft, and the unit period is ⅔ of the second period.

9. An image forming device including the two-component delivery system of claim 1, wherein the first material comprises toner and the second material comprises a carrier, and the system further comprises a developing roller that collects the mixed carrier and toner to transfer the toner from the circulating part to an opto photo-organic conductor to impart an image on a medium using the delivered toner.

* * * * *